United States Patent [19]

Orlando

[11] Patent Number: 4,801,100

[45] **Date of Patent: * Jan. 31, 1989**

[54] SYSTEM FOR DISCHARGING BALL MILLS

[75] Inventor: John J. Orlando, Rivervale, N.J.

[73] Assignee: Inco Alloys International, Inc., Huntington, W. Va.

[ * ] Notice: The portion of the term of this patent subsequent to Aug. 5, 2003 has been disclaimed.

[21] Appl. No.: 712,703

[22] Filed: Mar. 15, 1985

[51] Int. Cl.[4] ..... B02C 17/10

[52] U.S. Cl. ..... 241/171; 141/284; 241/101.2; 241/176; 241/180

[58] Field of Search ..... 241/101.2, 171, 176, 241/180, 284, DIG. 14; 366/184, 185, 188, 192, 187, 189; 141/268, 377, 284; 222/170, 171, 172

[56] References Cited

U.S. PATENT DOCUMENTS

| | | | |
|---|---|---|---|
| 750,330 | 1/1904 | Wünsch | 366/187 |
| 1,363,620 | 12/1920 | Sellman | 241/180 X |
| 1,907,785 | 5/1933 | Garlick | 241/180 X |
| 2,122,399 | 7/1938 | Abbe | 83/9 |
| 2,670,139 | 2/1954 | Treshow | 241/171 X |
| 2,904,322 | 9/1959 | Bruff | 366/187 |
| 4,054,292 | 10/1977 | Stone | 277/12 |
| 4,582,268 | 4/1986 | Adelmann | 141/284 X |

FOREIGN PATENT DOCUMENTS

| | | | |
|---|---|---|---|
| 843090 | 7/1952 | Fed. Rep. of Germany . | |
| 2301137 | 1/1973 | Fed. Rep. of Germany . | |
| 3146365 | 7/1982 | Fed. Rep. of Germany | 241/171 |
| 3241784 | 1/1983 | Fed. Rep. of Germany . | |
| 2145282 | 1/1973 | France . | |
| 2439028 | 10/1980 | France . | |
| 530694 | 2/1977 | U.S.S.R. | 241/171 |

OTHER PUBLICATIONS

Catalog B-8 of Paul O. Abbe Inc., entitled Ball & Pebble Mills.

*Primary Examiner*—Joseph M. Gorski

*Attorney, Agent, or Firm*—Raymond J. Kenny; Edward A. Steen

[57] ABSTRACT

A rotary batch-type grinding mill for processing powder is provided with an improved system for discharging material under seal from the atmosphere. The discharge system comprises a sealable collection chute having a banana-like configuration secured on the mill shell at an outlet port in the shell and extending substantially parallel to the circumference of the shell, a grate which prevents discharge of the grinding media from the mill during unloading of material from the mill and an elastomeric faced sealing plate which covers the grate during operation of the mill. The sealing plate is operated from outside the sealed system so that discharge from the mill can be effected without breaking the seal and the sealing plate is so disposed that in the open position it does not interfere with the flow of powder out of the mill.

8 Claims, 4 Drawing Sheets

35
37
36
42a
42
38
46
39
52a
33
34
32
31
52b
15
19
47
21
15

SYSTEM FOR DISCHARGING BALL MILLS

FIELD OF INVENTION

This invention relates to an improved system for discharging rotary grinding mills under controlled environmental conditions. More particularly it relates to a system for discharging particulate material from batch-type, rotary mills under seal to the atmosphere.

BACKGROUND OF INVENTION

In milling certain types of materials it is often necessary or desirable to have a positive control of the atmosphere within the mill at all times. For example, readily oxidizable materials such as aluminum, titanium, magnesium, lithium and fine powders of many compositions are combustible or even explosive under certain conditions or they may be contaminated by the presence of air. In milling such materials the control of the atmosphere must extend to charging and discharging of the mill without opening the mill to air.

The present invention is not restricted to any particular materials. However, it is described below with reference to metal powders which are readily oxidized and are prepared as dispersion strengthened materials or alloys by powder metallurgy routes. Of necessity the milling of such materials must be carried out in a controlled atmosphere. The environment in the mill may be, for example, inert or may contain low levels of oxygen, hydrogen or hydrocarbons. To obtain such an atmosphere it is generally necessary to seal the mill to air.

The problems encountered in milling powders are particularly troublesome in mechanical alloying of readily oxidizable metals such as aluminum, magnesium and lithium. Mechanical alloying has been described in detail in the literature and in patents. U.S. Pat. Nos. 3,740,210, 3,816,080 and 3,837,930, for example, involve the mechanical alloying of aluminum alloys and the composite materials containing aluminum. In practice of mechanical alloying the components of the product are charged in powder form into a high energy milling device such as a ball mill where, in an environment free of or reduced in amount of free or combined oxygen, the powders are ground down to a very fine size initially, prior to particle agglomeration in the latter stages of the process. This initial grinding increases the total surface area of the metallic powders significantly. Since any freshly exposed surface of the powder is not oxidized, it is very hungry for oxygen to the extent that the powders in this condition will burn and/or might explode spontaneously if exposed to air. Thus, any port in the mill, for example, for charge or discharge of powders, is a source of potential danger from the standpoint of the quality of the product produced and/or the possibility of fire and/or an explosion. To avoid problems of explosion, burning and contamination, the mill should be emptied while maintaining positive control of the environment in the mill and throughout the entire discharging system and with minimum retention of powder in the mill.

It has been known to operate a rotary mill with a plug in an opening in the shell, the plug being replaceable with a grate during discharge. For protection of the environment during discharge, the shell is enclosed in a housing. When the milling cycle is finished the housing is opened to replace the plug with a grate, then the housing is closed for the discharge cycle. During the discharge cycle the discharge opening is rotated to the underside of the shell, thereby permitting the powder to run into the housing. The rotation for discharge of material can be repeated. This arrangement is not satisfactory. It opens the system to the atmosphere when the plug is replaced by the grate. Powder discharged from the shell tends to accumulate in the housing, thereby requiring cleaning of the housing after each run and further opening the system to air. Opening of the housing and accumulation of powder in the housing are sources of contamination of the powder discharged from the mill and to subsequent runs in the mill. A further serious problem is that when the shell rotates inside the housing the discharging powder may be in the explosion range in terms of concentration of various portions of powder discharged in any cycle. Another proposed method for discharge is by gas sweep through the mill to pick up particles and carry them to a classification system. This involves the use of a combination of devices such as drop-out chambers, cyclones, bag filters, blowers and the like. Since the powder conveyed is combustible and/or explosive, the gas sweep system poses a significant hazard. Furthermore, it is difficult to seal against infiltration of air and against leaks. It is also difficult to control the flow of powder in the discharge.

In the present system the discharge of processed material, e.g. processed to an alloy powder, is essentially gravity-dependent, the material is not aerated, it is relatively easy to keep the entire system under sealed conditions throughout the milling and discharge cycles, and the mill is discharged with minimized retention of the discharge material in the mill. Further advantages of the present discharge system are that the maintenance of the system can be achieved with minimum disturbance to the mill, and it can be done completely from outside of the mill.

The present discharge system is especially useful for mills having shells of up to about 2 to 3 feet in length, and it is possible to empty the mill substantially completely.

The discharge system of the present invention can be incorporated into existing rotary mills, permitting them to be discharged under protective conditions.

STATEMENT OF THE INVENTION

In accordance with the present invention a batch-type grinding mill operable under seal to the atmosphere is provided with a system for discharging material from the mill, the discharge system permitting substantially complete emptying of the mill while maintaining the entire grinding system and discharge system under seal to the atmosphere, and the discharge system comprising:

(A) a rotatably mounted shell having an outer side wall, means to rotate the shell, a plurality of grinding media within the shell, and at least one discharge orifice through the outer side wall of the shell;

(B) blocking means securable across the discharge orifice for preventing passage of the grinding media outwardly therethrough;

(C) at least one collection chute sealably secured on the outer side wall of the shell over the discharge orifice and extending adjacent and substantially parallel to the circumference of the outer side wall, said collection chute having at least one entry port and one unloading end, the entry port providing a sealed access to the chute for material from the discharge orifice and the unloading end providing an atmospherically sealable exit passage from the chute, said unloading end being adapted to receive a receptacle for discharge and removal of discharge material from the chute under sealed conditions; and (D) a discharge orifice seal assembly for each discharge orifice, said discharge orifice seal assembly forming a part of the collection chute and comprising a removable closure means for sealing the discharge orifice against the outward flow of material from the shell into the collection chute, and means to open and close the closure means without disturbing the environment in the mill.

To balance the mill, balancing weights may be used or more than one chute can be installed. Each chute may accommodate more than one discharge orifice. However, for discharge of material under a controlled environment, the discharge orifice must empty into a chute. The blocking means over each discharge orifice, e.g. a grate, sieve or screen (herein after referred to generally as a grate), has openings sized to prevent the grinding media from outward discharge from the shell into the chute. The grates are sealably mounted across the orifice and may be located in the shell or in the discharge assembly, sealable in the discharge orifice during the discharge mode of the mill. The grinding media may be balls, pebbles, rods or any other appropriate device.

During operation of the mill under seal to the atmosphere the closure means is secured over the discharge orifice in the shell. The collection chute (or chutes) is retained on the mill, preferably with its unloading end sealed to the atmosphere, e.g. with a valve and closure cap, as a back-up to the discharge port seal. It is possible to retain the collection chute on the mill during the processing mode because of the spatial relationship of the collection chute to the mill shell and the closure means which can be secured over each discharge orifice.

To discharge material the rotation of the mill is stopped and the seal, e.g. a plate, across the orifice (and grate) is retracted. The mill is rotated a number of times (with the collection chute unloading port sealed). The discharge material, e.g. a processed powder, will collect in the chute. Since the powder will reverse direction in the chute at the end of each rotation a deflector plate is placed in the chute just ahead of the grate so that the powder "jumps" over the grate as it flows to the other end of the chute. Eventually the chute stagnates (no additional powder will accumulate in the chute), whatever enters the chute flows back through the grate. This stagnatory point depends on the cross-sectional area of the chute. The chute must be at least sufficiently long to hold the volume of powder collectable up to stagnation. After stagnation or complete discharge of the mill, the shell rotation is stopped, and an unloading receptacle, e.g. a sealed drain can, is connected to the end of the chute, e.g. by means of a valve arrangement and adapter. The chute collection container valves are opened and the powder flows into the unloading receptacle. The cycle of collection and draining is repeated until the mill is empty.

The speed of discharge is complex. The amount of powder that can be collected in the chute depends on its cross-sectional area. Length is a factor, but beyond a certain point, stagnation occurs and further length adds nothing but weight and cost. Rotation speed during discharge is also a factor - at higher speeds discharge is faster.

The material processed in the mill may comprises elements, compounds, mixtures, alloys, ceramics and combinations thereof. Examples of elements which may be present in major or minor amounts are nickel, copper, zinc, titanium, zirconium, niobium, molybdenum, vanadium, tin, aluminum, silicon, chromium, magnesium, lithium, iron, yttrium and rare earths; e.g. cerium and lanthanum; examples of compounds are oxides, nitrides and/or carbides of alimunim, magnesium, yttrium, cerium, silicon and lanthanum; examples of alloys are master alloys of aluminum-lithium and aluminum-magnesium. The present invention is particularly useful when the material to be processed must be charged to and/or processed in a mill under a controlled atmosphere. The present invention is particularly advantageous for processing in a ball mill metal powders which are readily oxidized and are prepared as dispersion strengthened materials or alloys by powder metallurgy routes. Of necessity the milling of such materials must be carried out in a controlled atmosphere, e.g., in a hermetically sealed or a purgative atmosphere, or in an environment of controlled gas or gas flow. However, it will be understood that the present invention is, generally, especially useful for processing in a mill any materials where a controlled atmoshpere is required or beneficial. For example, the present invention can be used advantageously for preparing by a powder metallurgy route dispersion strengthened alloys having, e.g., nickel, copper, iron, titanium, magnesium or aluminum as a major constituent.

BRIEF DESCRIPTION OF DRAWING

A further understanding and advantages of the invention will become apparent from the following description taken in conjunction with the accompanying drawing in which.

DESCRIPTION OF A PREFERRED EMBODIMENT

Figure 1A:
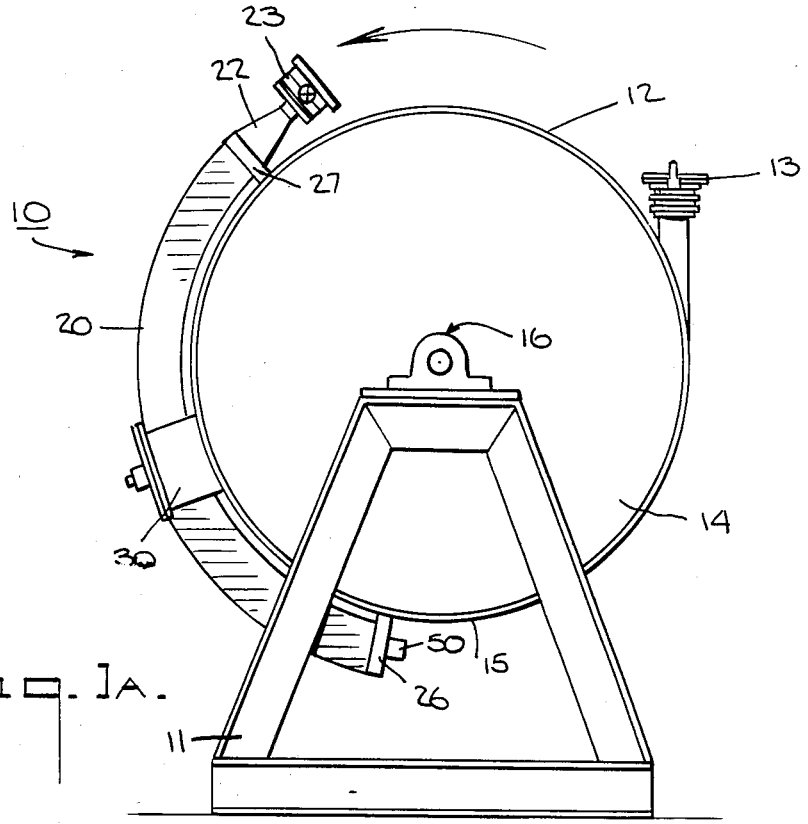
FIG. 1A is an end elevation view of a ball mill showing a discharging system in accordance with the present invention in position during operation of the mill, the arrow showing the direction of rotation.
Figure 1B:
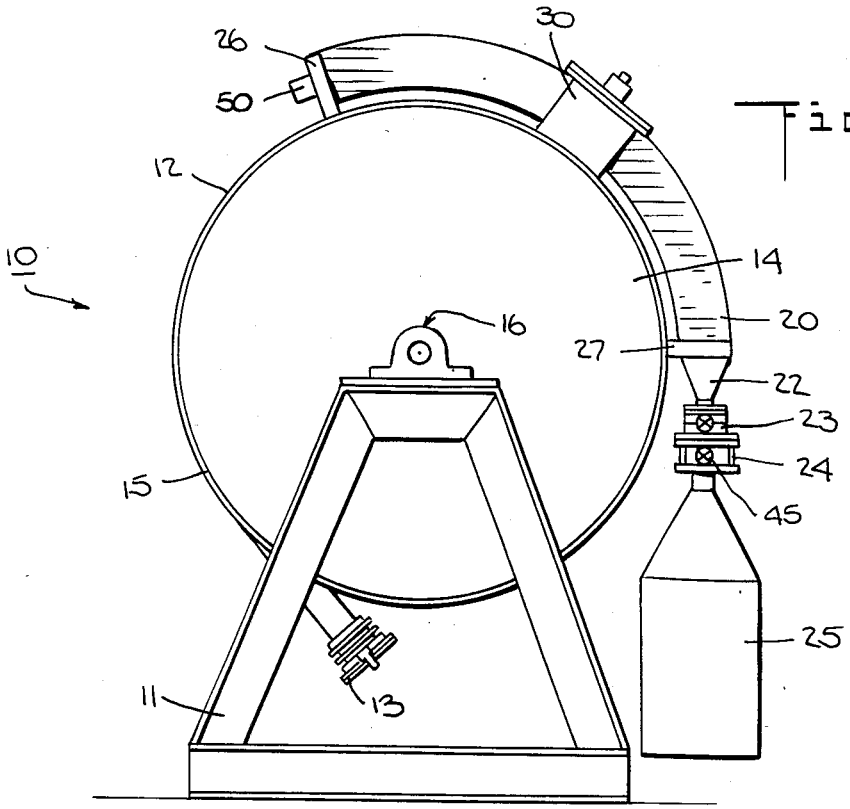
FIG. 1B is the same view of the ball mill as FIG. 1A except that the discharging system is shown in position for discharging material from the collection chute, with a receptacle for unloading attached to the discharge assembly.

Referring to the drawing, FIGS. 1A and 1B show an end elevation diagrammatic view of ball mill 10, in the operation or collection mode in FIG. 1A, and in the unloading mode in FIG. 1B. The ball mill comprises support frame 11, rotatably mounted cylindrical shell 12 having an end 14 and wall 15. Orifice 18 (not shown in FIGS. 1A or 1B) in wall 15 is provided for discharge of material from the shell. Charging means 13 is disposed as disclosed in U.S. Pat. No. 4,679,736. (Other suitable devices may be used.) The charging means is not fully shown in the drawing. The discharge assembly is shown in various modes of opeation and in various details in the drawing, as described below. The ball mill contains a plurality of balls (not shown), and the shell is rotated about a substantially horizontal axis on trunnion bearing 16 by a motor (not shown) through a gear reduction means (not shown). Means for establishing a controlled environment in the mill are not shown.

Collection chute 20 has entry port 21 aligned with discharge orifice 18, and unloading end 22. Valve 23 on the unloading end serves to seal the chute and material therein from the atmosphere during the collection mode, and adapter 24 enables the sealed connection of the collection chute 20 with an unloading receptacle 25, e.g. as shown in FIG. 1B. Incorporated in collection chute 20 is discharge orifice seal assembly 30, which is located in the collection chute so as to enable the sealing of discharge orifice 18 during the operation mode of the mill. Straps 26 and 27 assist in securing the collection chute on the shell wall but other appropriate means could be used.

Figure 2A:
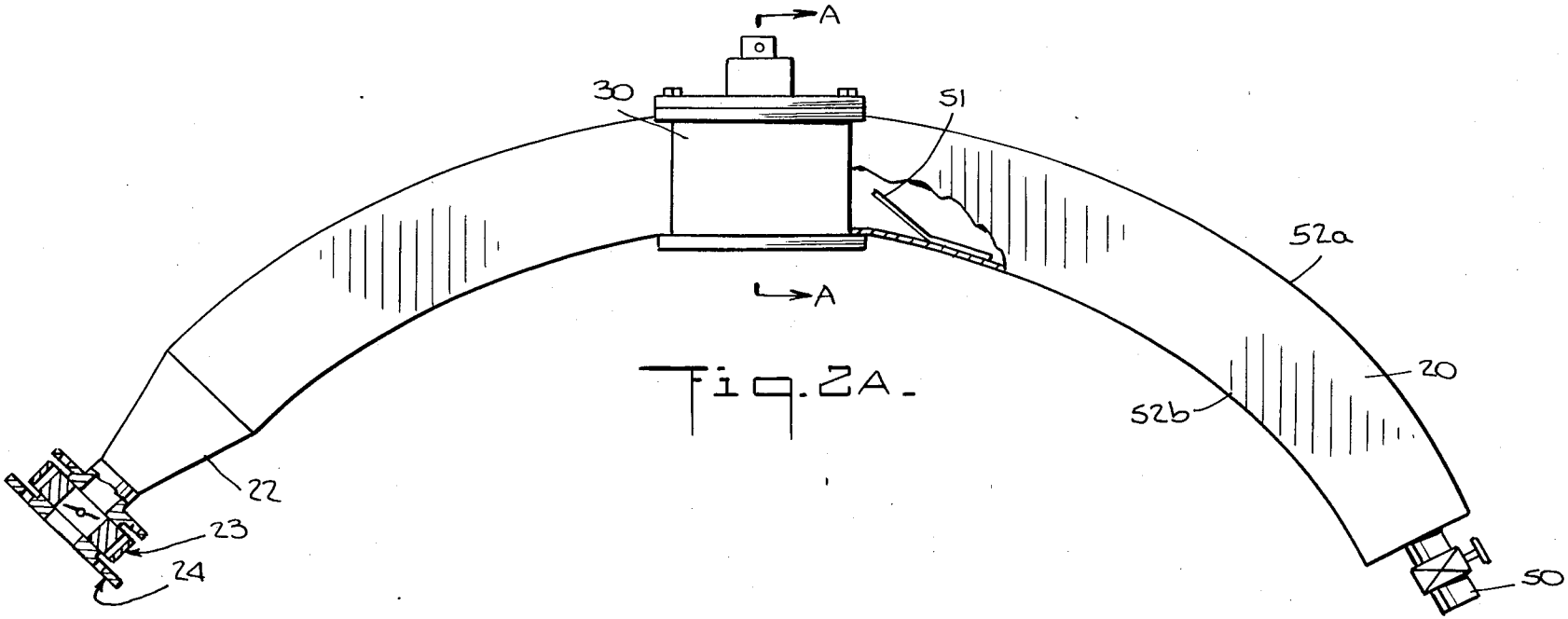
FIG. 2A is a side view of a collection chute and discharge orifice seal assembly, showing its "banana" like structure.
Figure 2B:
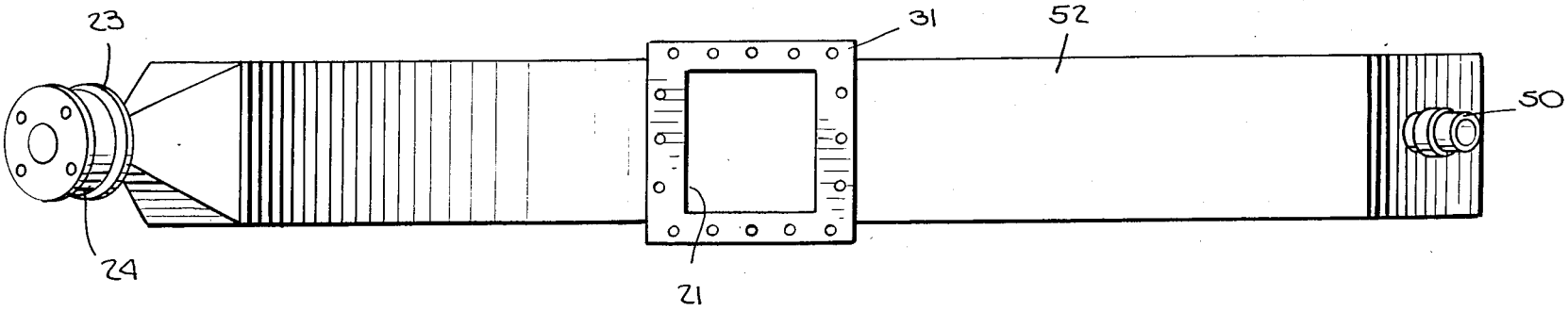
FIG. 2B is a bottom view of the apparatus of FIG. 2A.
Figure 3A:
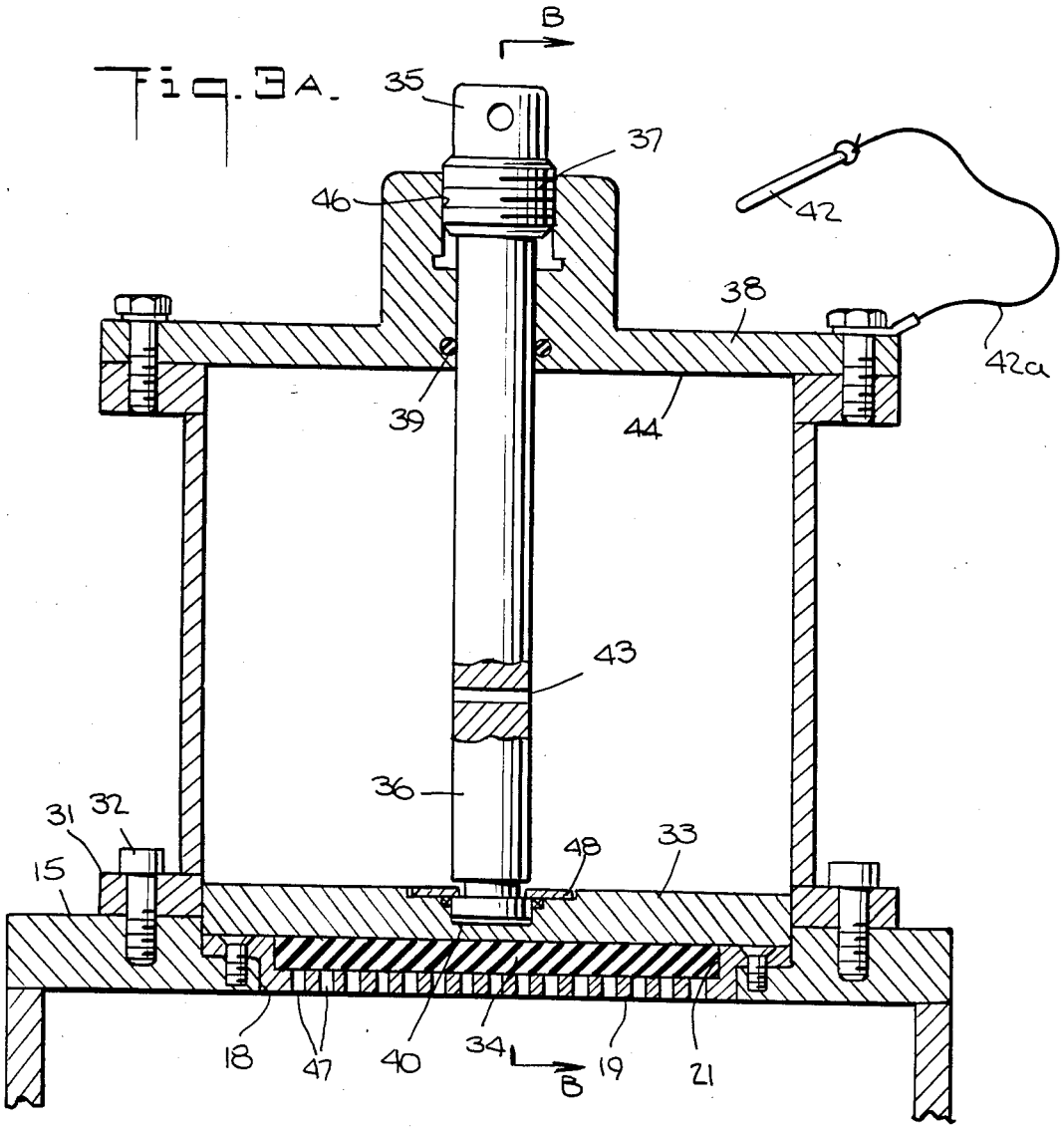
FIG. 3A is a cross-section of the discharge orifice seal assembly along section A—A of FIG. 2A, showing the closure means in the closed position.
Figure 3C:
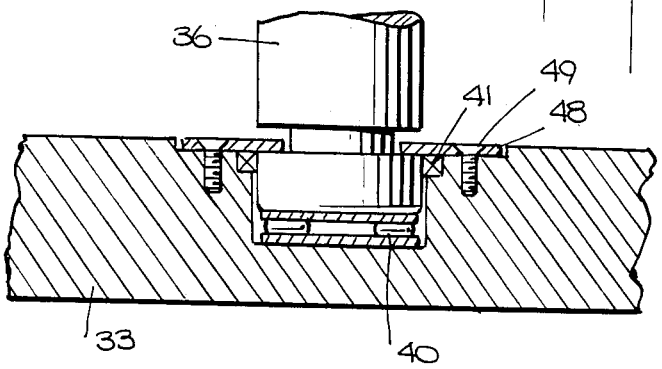
FIG. 3C is a section of the end of the stem and elastomerfaced grate sealing plate showing bearing seal and thrust bearing details.
Figure 3B:
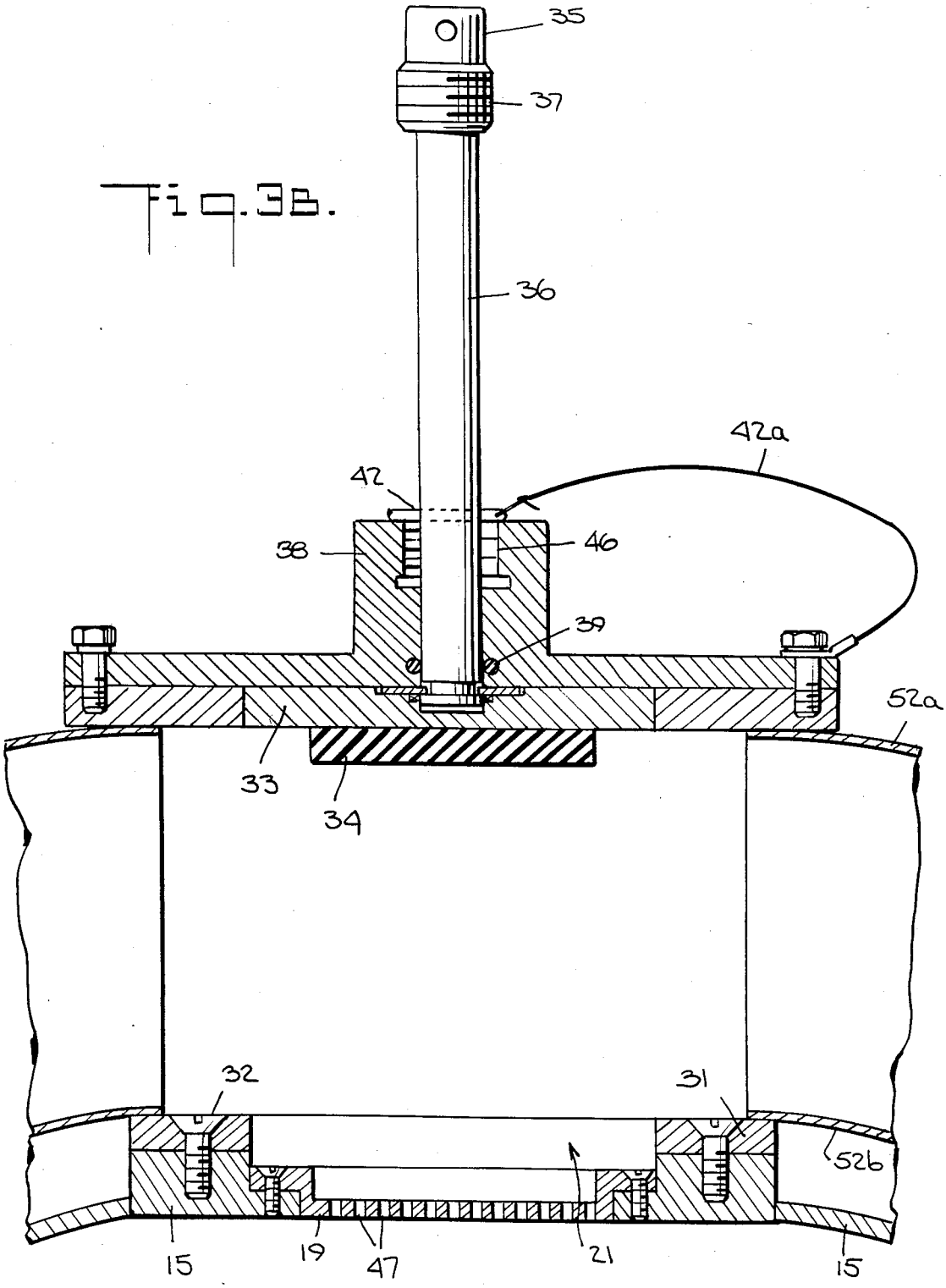
FIG. 3B is a section of the discharge orifice seal assembly along section B—B of FIG. 3A, showing the closure means in the open position.

The "banana"-like structure of collection chute 20, having top and bottom walls **52*a* and 52*b*, is shown in FIG. 2A. Seal assembly 30 forms a part of the collection chute. Purge connection 50 can be used to purge the atmosphere in collection chute 20. As shown in FIGS. 2B and 3A seal assembly 30 for discharge orifice 18 is sealed to the mill shell wall 15 by flange 31 and bolts 32. Orifice 18 is covered with grate 19 to prevent the balls from falling out of the mill. During milling grate 19 is sealed with seal plate 33 which is faced with elastomeric gasket 34. Elastomeric gasket 34 is held against grate 19 by stem 36, having threaded section 37 on its end, and a portion 35 of stem 36 is operable outside the seal of the discharge system. As shown in FIGS. 3B and 3C the connection of seal plate 33 to stem 36 is fitted with thrust bearing 40, bearing seal 41 and split retaining clip 48 secured with screws 49. Stem 36 is slidably sealed to cover plate 38 with "O"-ring 39, or other appropriate sliding seal. The threaded section 37 of stem 36 is used to hold grate seal plate 33 in place during milling. To hold the grate seal plate 33 open during mill discharge, pin 42, tethered by cable 42*a* is inserted in hole 43 after retracting stem 36 past threaded section 46 of cover plate 38. Deflector plate 51** adjacent to the grate permits an increase in the amount of powder collected during a discharge cycle.

FIG. 3A, section A—A of FIG. 2A, shows details of the discharge system at discharge orifice 18, with the closure means, i.e. and elastomeric faced metal plate, (seal plate 33) sealing the orifice. Grate 19 across orifice 18 has openings 47 sized to retain the balls in the mill.

FIG. 3B, section B—B of FIG. 3A, shows a section of the closure means held in the open position with pin 42 in hole 43 of stem 36. Top and bottom walls **52*a* and 52*b***, respectively, of the collection chute extend from both sides of the discharge seal assembly.

The rotary mill 10 rotates about a substantially horizontal axis. During processing of material, e.g. metal powders (not shown), in the mill, the discharge and charging orifices in the rotary shell are sealed so that nothing can pass outwardly from the shell. In the closed, sealed condition elastomeric gasket 34 is pressed against grate 19 by means of threaded section in stem 36 of the sealing member, blocking the orifice 18 and thereby preventing powder from passing from the mill shell into the collection chute. The unloading end 22 of the collection chute is sealed by valve 23, e.g. a butterfly or other appropriate valve. thus, the entire discharge system is sealed to the atmosphere. For discharging powder to the collection chute, stem 36 in the seal assembly 30 is released by relieving the pressure at the threaded end 37 located through cover plate 38 of the seal assembly. Plate 33 is raised by pulling stem 36 outwardly, sliding it through a sealing means 39 until the hole 43 in the rod is above the cover plate 38. Pin 42 is then inserted to retain the grate sealing means away from the grate see FIG. 3B. In the preferred embodiment in the open position plate 33 is flush against inner wall 44 of the cover plate 38. During rotation of the cylinder, e.g. in a counterclockwise direction (for the position shown for the chute in FIG. 1A), and powder is released through the grate 19 into the collection chute.

To unload the powder, the shell is rotated so that the unloading end 22 of the collection chute faces directly normal to a horizontal base line. An unloading receptacle 25 under seal, e.g. with a valve 45 is fitted onto the unloading end 22 of the collection chute via adapter 24. The valve 45 in the receptacle then the valve 23 in the unloading port of the collection chute can be opened, and under sealed condition the powder passes from the collection chute into the receptacle. Before removal of the receptacle the valves in the unloading receptacle and the unloading end of the collection chute are closed.

The above operation can be repeated, if necessary, until the mill is empty.

The discharge assembly hereinbefore described is characterized by a means to seal the mill from the atmosphere during operation of the mill, during discharge of material from the mill into a collection system attached to the mill with retention of the grinding media in the mill, and during and after unloading material from the collection system. One of the advantages of the system, apart from the seal to the atmosphere, is that the discharge system prevents fine powders from leading from the mill into the discharge system during processing of the powders in the mill. By operation of the present discharge system the processing conditions can be controlled, the quality of the product processed in the mill can be insured and hazardous conditions can be prevented.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

The embodiments of the invention in which an exclusive property or privilege is claimed are defined as follows:

1. A batch-type grinding mill operable under seal from the atmosphere and provided with a discharge system for discharging material by outward flow from the mill, the discharge system permitting substantially complete emptying of the mill while maintaining the grinding mill and discharge system under seal from the atmosphere, and the discharge system comprising:

(A) a rotatably mounted shell having an inner environment and an outer side wall, said outer side wall having a circumference, means to rotate the shell, a plurality of grinding media within the shell, and at least one discharge orifice in the outer side wall of the shell for outward flow of material from the shell;

(B) blocking means securable across the discharge orifice for preventing passage of the grinding media outwardly therethrough, said blocking means comprising a grate (C) at least one collection chute secured on the outer side wall of the shell over the discharge orifice and extending adjacently and substantially parallel to the circumference of the outer side wall, said collection chute having at least one entry port and one unloading end, the at least entry port being aligned with the discharge orifice and providing an atmospherically sealed access to the collection chute for material from the discharge orifice, the unloading end being provided with an exit opening and sealing sealing means for sealing the exit opening, and said unloading end having adapter means for receiving a receptable for discharge and removal of discharge material from the collection chute under sealed conditions; and (D) a discharge orifice seal assembly for the discharge orifice, said discharge orifice seal assembly forming a part of the collection chute and comprising a removable closure means for sealing the discharge orifice against the outward flow of material from the shell into the collection chute, and means to open and close the closure means without disturbing the environment in the mill, said closure means having open and shut positions, and said closure means in the open position permitting substantially unencumbered outward flow of material from the shell.

2. A discharge system of a mill according to claim 1, wherein the closure means for sealing the discharge orifice comprises a slidably retained sealing member mounted to one end of a stem, said sealing member being an elastomeric faced plate sealable across the discharge orifice, and the opposite end of said stem being outside atmospherically sealed conditions.

3. A discharge system according to claim 2, wherein the stem of the closure means has a screw means to pressure fit the elastomeric faced plate against the grate of the discharge orifice.

4. A discharge system according to claim 2, wherein the stem of the closure means has means for retaining the sealing member in the open position during discharge of material from the rotatably mounted shell into the collection chute.

5. A discharge system according to claim 1, wherein the collection chute is secured to the rotatably mounted shell during rotation of the mill.

6. A discharge system according to claim 1, wherein the unloading end of the collection chute has a valve for sealing the collection chute from the atmosphere during operation of the mill and discharge of material from the mill into the collection chute.

7. A discharge system according to claim 1, wherein the mill shell is up to about 3 feet in length.

8. In a rotary batch-type ball mill for processing and discharging material in powder form, said mill being operable under seal from the atmoshpere, a discharge system for discharging material by outward flow from the mill, the discharge system permitting substantially complete emptying of the mill while maintaining the grinding mill and discharge system under seal from the atmosphere, and the discharge system comprising:

(A) a rotatably mounted shell having an inner environment and an outer side wall, said outer side wall having a circumference, means to rotate the shell, a plurality of grinding media within the shell, and at least one discharge orifice in the outer side wall of the shell for outward flow of material from the shell;

(B) blocking means securable across the discharge orifice for proventing passage of the grinding media outwardly therethrough;

(C) at least one collection chute secured on the outer side wall of the shell over the discharge orifice and extending adjacently and substantially parallel to the circumference of the outer side wall, said collection chute having at least one entry port and one unloading end, the at least one entry port being aligned with the discharge orifice and providing an atmospherically sealed access to the collection chute for material from the discharge orifice, the unloading end being provided with an exit opening and for sealing the exit opening and said unloading end having adaptor means for receiving a receptacle for discharge and removal of discharge material from the collection chute under sealed conditions; and (D) a discharge orifice seal assembly for the discharge orifice, said discharge orifice seal assembly forming a part of the collection chute and comprising a removable closure means for sealing the discharge orifice against the outward flow of material from the shell into the collection chute, and means to open and close the closure means without disturbing the environment in the mill, said closure means having open and shut positions, and said closure means in the open position permitting substantially unencumbered outward flow of material from the shell.

* * * * *